United States Patent [19]

Mainiero et al.

[11] Patent Number: 4,503,423

[45] Date of Patent: Mar. 5, 1985

[54] EXTENSIBLE AND RETRACTABLE BARRIER AND ELECTROMAGNETIC INTRUSION DETECTOR THEREFOR

[75] Inventors: Joseph J. Mainiero, Hauppauge, N.Y.; Michael R. Mainiero, Monroe; Arthur T. Stanley, Shelton, both of Conn.

[73] Assignee: Man Barrier Corporation, Seymour, Conn.

[21] Appl. No.: 340,516

[22] Filed: Jan. 18, 1982

[51] Int. Cl.[3] ..... G08B 13/18; H01P 3/00; E04H 17/04; B21F 25/00

[52] U.S. Cl. ..... 340/552; 256/8; 333/242

[58] Field of Search ..... 340/552; 256/8, 2, 24; 333/242, 239

[56] References Cited

U.S. PATENT DOCUMENTS

| | | | |
|---|---|---|---|
| 2,908,484 | 10/1959 | Uhl | 256/8 |
| 3,463,455 | 8/1969 | Meckel | 256/8 |
| 4,040,603 | 8/1977 | Mainiero | 256/8 |
| 4,187,501 | 2/1980 | Olesch et al. | 340/552 |
| 4,274,226 | 6/1981 | Evans | 340/552 |

FOREIGN PATENT DOCUMENTS

| | | |
|---|---|---|
| 603941 | 12/1932 | Fed. Rep. of Germany . |
| 862100 | 2/1941 | France . |
| 480082 | 2/1938 | United Kingdom . |

*Primary Examiner*—Glen R. Swann, III
*Attorney, Agent, or Firm*—Hayes & Reinsmith

[57] ABSTRACT

A continuous strip of coiled material is provided with protrusions, such as barbs, which are oriented to eliminate mutual interference when the coiled material is stacked in a compact, collapsed nested condition and wherein each turn of the coil is permanently fixed at equiangularly spaced multiple points alternately to its adjacent trailing and leading turns of the coil. An intrusion detection system signals intrusion into the space encompassed by the above mentioned coil and features a microwave energy source, receiver and detector for indicating a reduction in received microwave energy at the receiver indicative of intrusion into or other disruption of the energy guided path determined by the coil. Another embodiment of the barrier provides for similarly barbed strip material provided in a series of linear lengths with each length reversely folded at a succession of fold points to provide a sawtooth profile with the fold points permanently fixed alternately to corresponding fold points of adjacent trailing and leading strip lengths.

36 Claims, 13 Drawing Figures

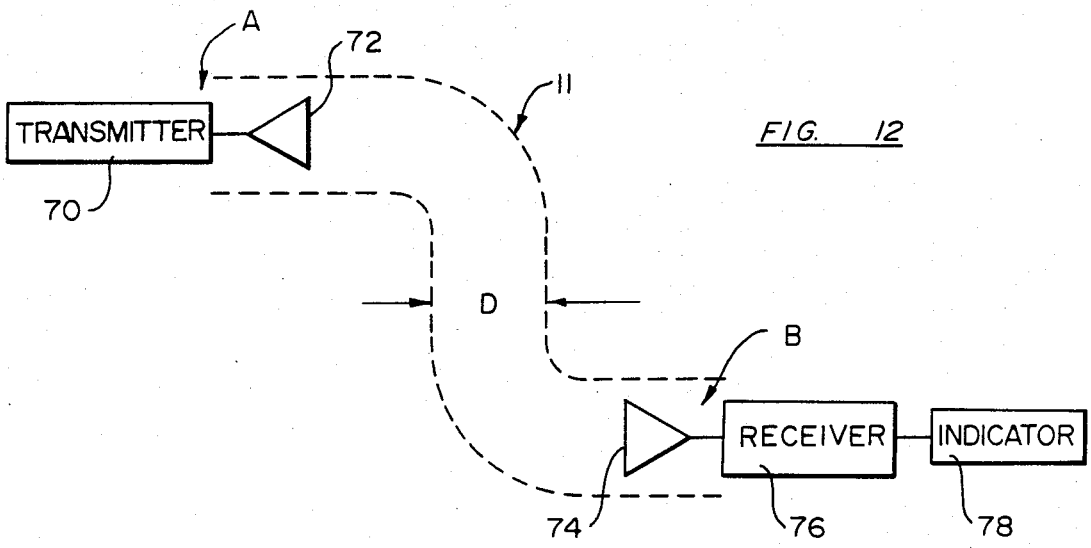
FIG. 12
FIG. 13
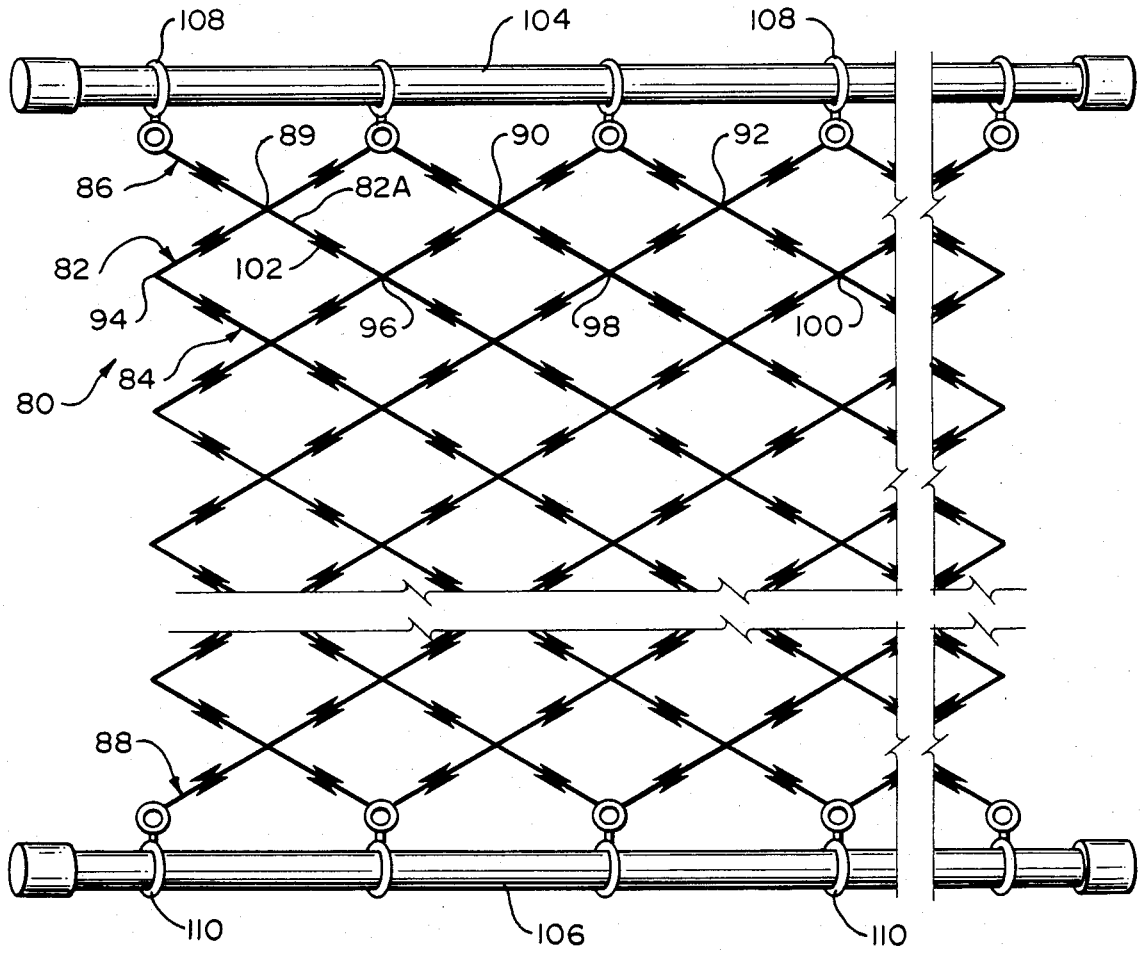

EXTENSIBLE AND RETRACTABLE BARRIER AND ELECTROMAGNETIC INTRUSION DETECTOR THEREFOR

FIELD OF THE INVENTION AND CROSS REFERENCES TO RELATED ART

This invention generally relates to barrier devices formed of strip material into coiled and planar barriers, particularly of a barbed type. A coil of such material may be stretched from a collapsed, nested condition into a generally cylindrical obstruction for use, e.g., as an anti-personnel barrier. The barrier coil of this invention is particularly suited to be deployed along a desired barrier trace with a predetermined maximum length and minimum diameter for rapid interference-free deployment and subsequent collapsing of the barrier coil into its original condition for re-deployment. Units of this general type are disclosed in U.S. Pat. No. 3,463,455 to Meckel entitled "Helical Barbed Taped Units" and in U.S. Pat. No. 4,040,603 to Mainiero entitled "Barbed Metal Tape", both of which patents are assigned to the assignee of this invention.

SUMMARY OF THE INVENTION

To assure interference-free use, a barrier coil of this invention features protrusions on a strip of coiled material which protrusions are oriented to avoid mutual interference with adjacent turns of the coil. Adjacent coil turns are permanently attached at corresponding points along the length of the coiled material. The resulting construction is significantly enhanced to provide a uniform cylindrical configuration, when stretched for installation, by selectively locating permanent attachment points on each turn of the barrier coil in alternating circumferential succession to adjacent leading and trailing turns. Such construction effectively eliminates any possibility of relative longitudinal slipping or twisting at the point of attachment of one coil turn to its adjacent turns and ensures repeated retraction of the extended coil into its original collapsed condition, when desired, for re-depolyment. Stretching of the barrier coil is yet further controlled with regard to its maximum length and minimum diameter by interconnecting equal lengths of unique spacer devices between corresponding points of successive coil turns to extend longitudinally along the length of the coil. While spacer devices are known, as shown in the referenced Meckel U.S. Pat. No. 3,463,455, such conventional techniques are fraught with troublesome entanglement difficulties, particularly during recovery and have frequently been limited in use to one-time, permanent installation applications. In contrast, the subject invention utilizes a coil spacer technique particularly suited for high speed deployment on an emergency basis, if required, and also is adapted for quick and easy repeated recovery and redeployment of the disclosed barrier coil. In accordance with the teachings of this invention, a relatively stiff length of material comprising the spacer device is provided between coil turns and which preferably features a memory set to return to a folded, interference-free position within the coil upon its collapse.

Moreover, the described barrier coil in uniquely adapted to provide an intrusion detection system for signaling intrusion into the space encompassed by the coil when coupled with a microwave transmitter receiver system incorporating a detector for providing a readout indicative of intrusion or other disruption of the microwave energy guided path as determined by the barrier coil.

Another embodiment of this invention is disclosed wherein a planar barrier is provided and which is closely related to the described barrier coil.

Other details, objects and advantages of this invention will become apparent as the following description of a presently preferred embodiment of practicing the same proceeds.

BRIEF DESCRIPTION OF THE DRAWINGS

FIG. 12 is a schematic view showing an intrusion detection system incorporating the barrier coil of this invention; and FIG. 13 is a isometric view, party broken away, showing a planar barrier of this invention.

DETAILED DESCRIPTION OF A PREFERRED EMBODIMENT

Figure 1:
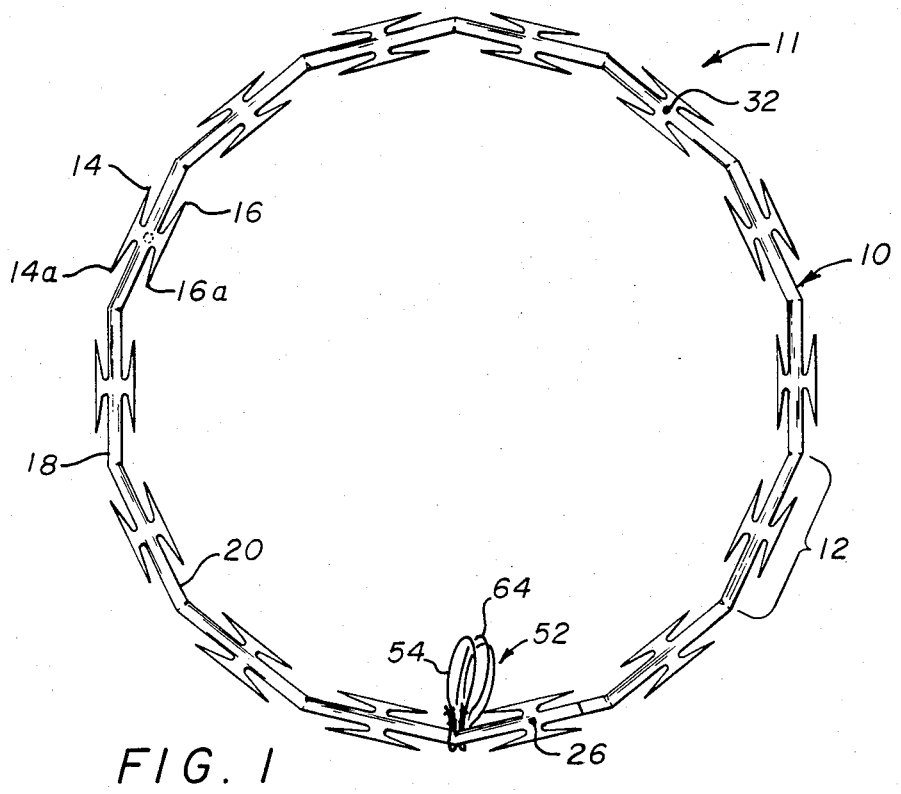
FIG. 1 is an end view of a barrier coil embodying this invention.
Figure 2:
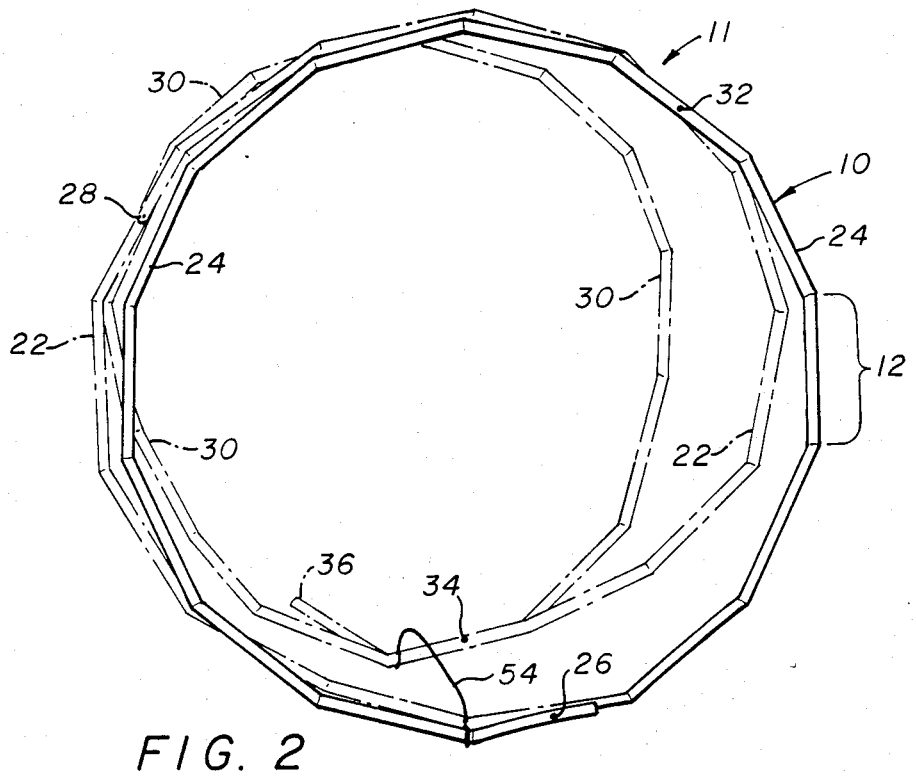
FIG. 2 is a view of the coil of FIG. 1 which has certain parts removed for clarity and shows two turns of the coil adjacent its end coil in offset relation to one another for purposes of illustration.

Barbed tape 10 is illustrated which will be understood to be of a type fully described in the above noted U.S. Pat. No. 4,040,603, the subject matter of which is incorporated herein by reference. Tape 10 is fabricated from linear, substantially planar, flat metal strip stock. Tape 10 has a continuous series of closed loops or turns normally defining a helical coil 11 with each closed turn preferably having adjoining equally angularly offset linear segments of equal length such as at 12 (FIGS. 1 and 2). Each turn of coil 11 is so formed as to be readily retracted into stacked confronting, nesting, collapsed relation to its adjoining connected turns.

Figures 7, 8:
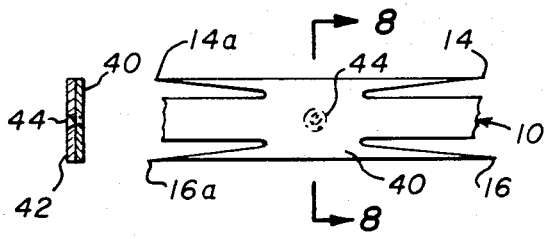
FIG. 7 is an enlarged plan view, partly broken away, showing a portion of the coil.
FIG. 8 is a cross-section view taken generally along line 8—8.
Figures 9, 10:
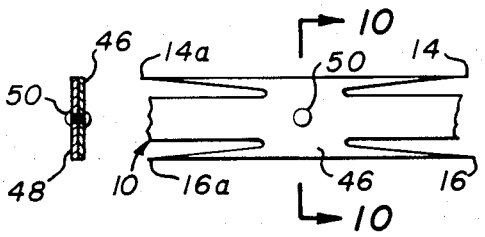
FIG. 9 is an enlarged plan view, partly broken away, showing a portion of another coil.
FIG. 10 is a cross-section view taken generally along line 10—10 of FIG. 9.

Tape 10 preferably is constructed with identical barb clusters each having four needle-sharp barbs with each four-barb cluster having two-barb pairs 14, **14*a* and 16, 16*a* spaced opposed along opposite tape edges 18 and 20 (FIGS. 1, 7 and 9). For example, each barb pair may be, say, 2.375 inch long and equally spaced apart on about four inch centers repeatedly along the length of tape 10** dimensioned, e.g., to be 0.025 inch thick and about 1.195 inch wide at the maximum width of the tape across barbs and fabricated for general purpose use, say, with 24 and 30 inch diameter turns. Such tape may be fabricated from flat strip stock of high carbon steel and is particularly suited to be formed from austenetic stainless steel 0.025 inch thick, e.g., hardened to Rockwell 30 N, 50–70.

The barbs of each pair 14, 14*a* and 16, 16*a* respectively extend in opposite directions longitudinally of tape 10, and it will be understood that barb pair 14, 14*a* of each cluster is preferably reversely oriented relative to barb pair 16, 16*a* in inclined relation to the plane of tape 10.

Tape 10 may also be fabricated to provide a crown, not shown, if desired, in the plane of tape 10 such that the finished tape in cross section curves to promote nesting of stacked turns when tape 10 is retracted as well as to effectively resist deformation when installed in stretched or extended condition, for example, an an anti-personnel barrier. The plane of the crowned but substantially planar tape 10 will be understood to be that plane containing the longitudinally extending outside and inside tape edges 18 and 20.

The barb clusters are positioned in precise corresponding relation to one another along each turn of coil 11 such that linear segments 12 and their barb clusters or each closed turn of the coil may be positioned in face-to-face contact engagement with corresponding elements of their connected adjacent turns throughout their entire length when the turns are retracted to nest in an axially aligned arrangement.

As disclosed in the referenced U.S. Pat. No. 4,040,603, the strip is initially formed with oriented barbs and the strip is then edge bent in the plane of the tape 10 to form it into identical adjoining linear segments 12 whereby a substantially identically constructed succession of angularly off-set linear tape segments 12 are ensured. Thus, a uniformly controlled stacking of the turns of coil 11 in collapsed compact condition is obtained to ensure that the correspondingly spaced barb clusters are nested in face-to-face contact engagement with correspondingly aligned confronting clusters of the adjoining connected turns of coil 11. As illustrated in FIG. 1, each barb cluster is formed intermediate the ends of its respective linear tape segment 12 at a point midway between its ends to ensure the desired precision stacking of successive turns of the coil in a collapsed condition.

While the material and the details of the coil have been described with specific reference to the preferred illustrated embodiment, it is to be understood that the coil may be formed of any material combining the required properties of producibility, extensibility, retractability and structural strength required for obstruction and obstacle functioning. It is contemplated that, in addition to metal, other materials such as plastics are capable of being employed in this invention. Moreover, other specific basic entanglement constructions may be utilized in the practice of this invention such as a single coil concertina, e.g., with barbed metal tape fitted around a spring steel core wire.

To provide a barrier which can be readily recovered for repeated use and which is particularly suited for rapid deployment under emergency conditions and is thereafter retractable for re-use into a compact nested, collapsed stack in a facile manner, the barrier coil of this invention features rigid and permanent point attachments of each intermediate coil turn, between the end turns, to adjacent trailing and leading coil turns in circumferentially spaced succession about each such intermediate coil turn. Preferably, these points of attachment comprise an odd number of approximately equiangularly spaced points throughout each intermediate coil turn of 360°. Such construction, when coupled with the previously described oriented protrusions (which are constructed to avoid any mutual interference) positively insures that precision orientation is maintained even upon coil deployment, whereby any relative longitudinal movement or slipping or twisting of the adjacent coils at their points of attachment is prevented.

Figure 3:
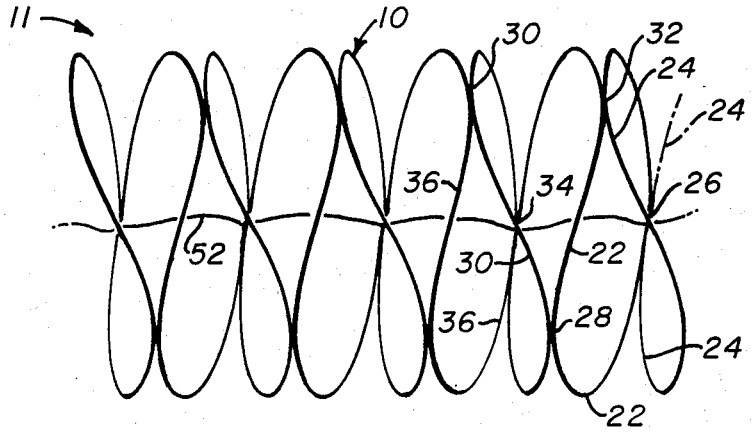
FIG. 3 is a top view of the coil of FIG. 1, on a reduced scale, shown in a stretched condition.
Figure 4:
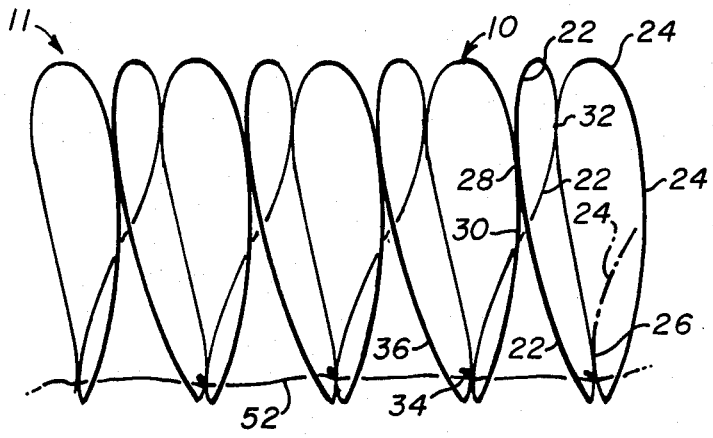
FIG. 4 is a side view of the coil of FIG. 3.

More specifically in reference to FIGS. 2–4, a first intermediate coil turn 22 (in leading relation to end turn 24 and described in FIGS. 3 and 4 from right to left) has an initial base point of attachment 26 to trailing end turn 24, a second point of attachment 28 to a leading intermediate coil turn 30 and a third point of permanent attachment 32 to trailing end turn 24 prior to the next circumferentially successive base point of attachment 34 of intermediate coil turn 22 to leading intermediate coil turn 36. Coil 36 and successive connected intermediate coil turns are likewise each alternately permanently attached to adjacent leading and trailing turns at spaced points throughout the coil length.

While different adjacent coil attachment devices and means may be used within the spirit of this invention, FIGS. 7–10 show two specific means of adjacent coil attachment which have been found to provide satisfactory results in rapid and repeated emplacement and recovery of a coil unit of the type described.

In the specific illustrations of adjacent point coil attachments illustrated in FIGS. 7 and 8, adjacent coil turns 40, 42 are illustrated as being spot welded at point 44, preferably at the center of confronting aligned barb clusters of the adjacent coil turns 40, 42. In FIGS. 9 and 10, adjacent coil turns 46, 48 are likewise rigidly and permanently secured to one another by a rivet 50 at the midpoint of the confronting barb clusters of turns 46, 48.

The number of points of rigid permanent attachment between adjacent coil turns may be varied depending upon whether the barrier provided is to be used for animal or human control purposes, as well as upon the desired size of the coil diameter when deployed and the like. Preferably, an odd number of permanent attachment points are employed for each coil turn. Examples of the number of attachment points which have been found to provide satisfactory results have ranged from three attachment points for each 360° turn for a collapsed coil 11 having an approximately 18 inch diameter to, say, nine attachment points for a 360° coiled turn for a 48 inch collapsed diameter coil. Since each of the adjacent turns are absolutely secured in fixed relation to one another at their points of attachment, precise nesting of coil 11 has been found to be assured.

Figure 5:
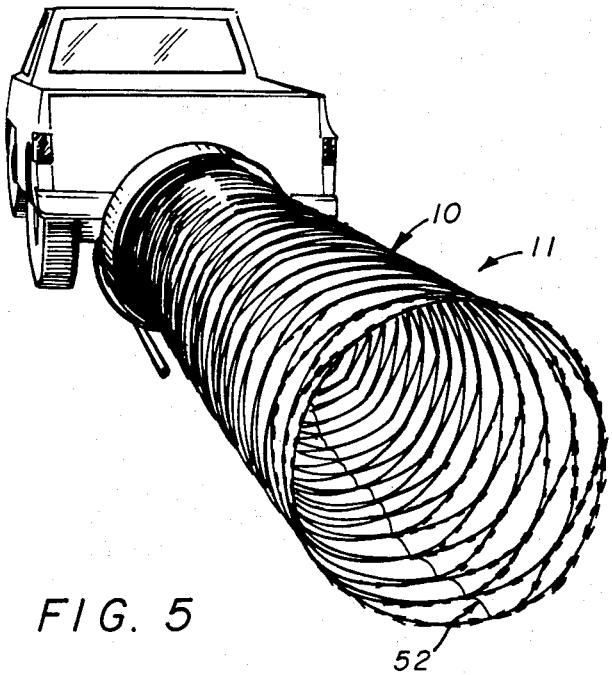
FIG. 5 is a perspective view of a barrier coil of this invention being deployed from a vehicle.
Figure 6:
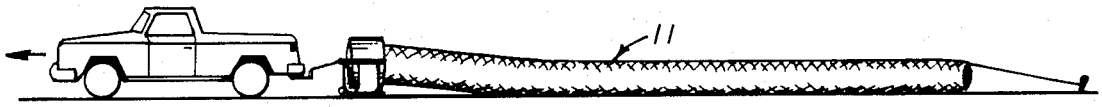
FIG. 6 is a reduced side view of the deployed coil and vehicle of FIG. 5.

To control the maximum length of an obstacle upon extending or deploying the coil unit of this invention and to insure a deployed coil minimum diameter whereby a continuous length of the strip material, even when stretched, exhibits a relatively uniform radius of curvature, a relatively stiff spacer device 52 may be provided (FIG. 11) to extend along the base of the cylindrical coil to be formed upon deployment (FIG. 5). In the specifically illustrated embodiment, the spacer device 52 extends longitudinally along the length of coil 11 at matching points between turns, preferably adjacent the above described points of permanent attachment between turns.

The spacer device 52 should have sufficient strengh and flexibility to provide repeated extension and retraction while bearing required obstacle dispensing loads.

Such construction additionally necessitates a relatively stiff spacer to minimize any potential deflection and consequent undesired entanglement with adjacent spacer devices 52 or with any coil protrusions (such as the illustrated barbs) to insure that the full and appropriate length of the extended barrier coil 11 is realized.

Figure 11:
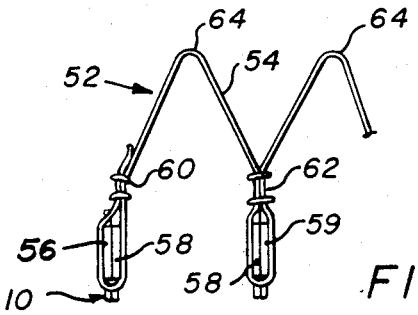
FIG. 11 is a side view, with certain parts removed for clarity, showing details of a spacer mechanism between successive corresponding points of the coil.

One spacer device 52 which has been used with success comprises thin metal lengths of strap with opposite ends fixed between coil turns and having a substantially rectangular cross section with a width to thickness ratio established, say, at about 24 to 1. In FIG. 11, an alternative to providing a spacer strap is illustrated which also provides the requisite stiffness to insure that the spacer device controls coil turn separation and yet does not deflect or tangle with adjacent spacer devices and/or coil protrusions. In FIG. 11, the spacer device or mechanism is formed by using a wire rope 54 such as 0.1875 inch diameter aircraft cable encased in a thin plastic jacket and secured adjacent the points of permanent attachment between coil turns 56, 58 and 58, 59 by fittings such as at 60, 62. It will be understood that the lengths of the jacketed aircraft wire rope cable 54 extending between fittings 60, 62 are approximately equal and secured at matching points successively along the length of coil 11 to control its maximum length and minimum diameter. The plastic jacket encasing the cable 54 serves to readily accept a "set" or memory to cable 54 without undesirably increasing the overall diameter of the cable assembly. Upon collapsing of coil 11, the memory of the aircraft cable 54 or wire rope assembly, which memory is preselectively established, serves to loop each length of spacer wire 54 about an intermediate bend zone 64 (FIGS. 1 and 11) so as to be located in an interference-free folded position on the interior of the coil when collapsed (FIG. 1).

The heretofore described hollow center physical barrier, having physical characteristics including a selected diameter determined by the disclosed spacing devices and the diameter of the adjacent coil turns, may be effectively used as a combination physical barrier and intrusion detection system. More specifically, it has been determined that the configuration of the barrier, whether single coil or multiple coil, uniquely exhibits a consistently uniform contour to provide a defined microwave beam path uniquely suited for use in sensing beam interference occasioned by entrance of a body or object into the beam path, separation, severing or other displacement of the barrier coil.

Referring to the schematic system shown in FIG. 12, it is seen that physical barrier coil 11 of this invention extends from point A to point B along a desired path, which path can be other than a straight line path. Because barrier diameter "D" is a known physical dimension, that dimension is used to determine a desired microwave electrical energy frequency which is used to provide remote physical intrusion recognition.

Extended coiled physical barrier 11 has been found to serve as a "guide" so that microwave energy will move axially along a path determined by the axis of barrier 11 without disabling energy dissipation; the term "guide" should not, however, be confused with the term "wave guide" as explained below. A suitable transmitter 70 is provided to drive an antenna 72 to emit microwave energy at a desired frequency. Coil barrier 11 guides a significant portion of that energy along the coil axis to receiving antenna 74 where receiver 76 converts that energy into the desired form for intrusion detection.

The coil barrier 11 does not, however, function as a wave guide wherein the energy loss is maintained at a low level because a continuous fixed dimension barrier (the wave guide) is not necessary. In the context of this invention, it is only necessary that the coiled barrier 11 serve to provide a path way for an appreciable amount of the microwave energy and that that energy be transmitted along the axis of barrier 11. Once it has been determined that a useful energy level reaches a receiver, any interruption or modification of that energy level can serve to sense any intrusion which serves to interrupt or modify the path of microwave energy propagation.

In a typical system, transmitter and receiver compatibility will have been predetermined as will the frequency of transmission. Moreover, the physical placement of the barrier serves to define an energy propagation path. While a certain percentage of the transmitted energy may be lost or otherwise dissipated because of the nature of the barrier, a significant portion of that energy reaches receiver 76. After level adjustments have been made at the receiver, it is thereafter possible to measure any decrease or modification in the energy reaching receiver 76 so as to trigger an intrusion indicator 78. It is also been found possible to provide adjustments in accordance with existing microwave technology so as to adjust the level of controls and the like to prevent false triggering of indicator 78, e.g., by weather conditions. It is also possible to provide for signal integration at the receiver 76, which signal integration will take place over a short time period to prevent spurious alarm information at the indicator 78 which may be caused by brief animal intrusion. Nonetheless, utilization of the physical barrier of this invention to "guide" microwave energy permits use of that physical barrier in combination with a suitable microwave transmitter and receiver to provide a further safeguard indication of intrusion into the space of coil barrier 11.

Turning now to another embodiment of this invention, a barrier panel 80 is depicted in FIG. 13. More specifically, a regular and repetitive pattern is preferably established for a planar barbed tape barrier by a plurality of linear lengths of strip or tape which are interconnected in a preselected pattern. The tape is linear and is foldable laterally of its major longitudinal axis but in other respects is preferably substantially identical to that of the previously described tape comprising the coil barrier embodiment.

As best seen in FIG. 13, each strip length such as illustrated at 82 and 84 is reversely folded at successive fold points longitudinally along each strip length to define a sawtooth profile. As shown, the fold points of each strip between opposite end strips 86, 88 are permanently fixed in alternating succession along each strip length to corresponding fold points of adjacent trailing and leading strip lengths. Accordingly, strip length 82, as an example, will be seen to be permanently fixed to trailing adjacent strip length 86 at alternating fold points 89, 90, 92 etc. and likewise is permanently fixed to leading adjacent strip length 84 at fold points 94, 96, 98, 100 etc.

In the preferred embodiment of the planar barbed barrier 80, the fold points of each strip length are equally spaced apart and form seqments of equal length along each strip length. As in the previously described coil barrier 11, the attachment or fold points of each strip such as 82 at 89 and 96 between adjacent tape strips 86 and 84, respectively, may be provided by a spot-weld permanently securing the adjacent strips at the selected fold points or, as an example, may be secured by other suitable means such as by a rivet at the juncture of the fold points thereby to insure that precise orientation of the barrier panel 80 is achieved. Any slipping, twisting or other undesired relative longitudinal movement of the adjacent strip lengths at their points of attachment is prevented. As in the previously described embodiment, suitable obstacle protrusions are preferably provided each strip length. In the specifically illustrated embodiment of FIG. 13, barbed clusters, as described above, are positioned in precise corresponding relation to one another along each tape segment (such as at 82A) preferably midway (such as at 102) between its ends as defined by its fold points (89 and 96). Each strip length of the barrier panel 80 accordingly may be positioned in face-to-face contact engagement with all corresponding elements of a connected adjacent trailing and leading strip length when the barrier panel is in retracted position, not shown, wherein all the strip lengths will be understood to be in a compact, collapsed and nested condition.

For controlling the position of the barrier panel 80 between its retracted position, not shown, and extended position (FIG. 13), suitable panel mounting means such as the illustrated pair of rods 104, 106 in FIG. 13 are shown to support each end strip 86, 88, respectively, of the panel. As illustrated, each end strip 86, 88 of panel 80 is preferably slidably secured to its respective rod by any suitable means such as rings at 108 and 110 to accommodate extension and retraction of the panel strips toward and away from their retracted barrier panel position. Other suitable panel mounting or supporting means may be provided depending upon the end application with which barrier panel 80 is to be used. As described, it will be seen that the barrier panel may be conveniently located over an entryway, or the like, and may be held by any suitable means in its retracted position overlying such an entryway to permit access under normal conditions and thereafter released into extended position, e.g., within suitable guideways, not shown, surrounding the entryway and thereby insure against unauthorized penetration of that entryway.

While a presently preferred embodiment of this invention has been shown and described, and a preferred embodiment of practicing the same has been illustrated, it is to be understood that the invention is not limited thereto, but may be otherwise variously embodied within the scope of the following claims.

We claim:

1. A barrier coil comprising a continuous strip of tape having a major surface with a face width dimension substantially greater than its thickness, the coil having multiple turns of substantially uniform diameter, the coil being extensible about its central axis from a retracted position to a deployed position, the coil in its retracted position having confronting major surfaces of ajdacent turns of the coil in collapsed nested face-to-face relation, the coil having turns rigidly and permanently fixed at circumferentially spaced multiple coil attachment points to adjacent trailing and leading turns of the coil, said coil attachment points continuously maintaining said confronting major surfaces of adjacent turns of the coil in abutting face-to-face surface contact engagement to prevent longitudinal or radial or pivotal movement of adjacent turns relative to one another at said coil attachment points, whereby the attachment points ensure return of the coil from deployed to retracted positions with the confronting major surfaces of adjacent turns of the coil in said collapsed nested face-to-face relation.

2. The barrier coil of claim 1 wherein the strip of coiled tape is formed of substantially planar metal strip stock comprising a plurality of closed turns of successive tape segments each angularly offset in the plane of the tape at a uniform bend angle to its trailing segment, the tape segments each being of substantially equal length, and wherein a barb cluster is formed on each tape segment midway between its ends.

3. The barrier coil of claim 2 wherein each barb cluster comprises two barb pairs on opposite edges of the tape with the barbs of each pair extending generally parallel to a central longitudinal axis of its linear tape segment, opposite barb pairs of each cluster on opposite tape edges being oriented to one another in reversely inclined relation to the plane of the tape to provide an "x" configuration when viewed from a side edge of the tape.

4. The barrier coil of claim 2 wherein the permanently fixed coil attachment points are equiangularly spaced apart on each intermediate turn of the coil, and wherein each such coil attachment point is located centrally of confronting barb clusters of adjacent coil turns.

5. The barrier coil of claim 1 wherein the strip of coiled tape is formed of metal, and wherein the permanently fixed attachment points of the adjacent coil turns are each formed by a spotweld permanently securing each coil turn to its adjacent turn at said attachment point.

6. The barrier coil of claim 1 wherein the permanently fixed attachment points of the adjacent coil turns are each formed by rivet means permanently securing each coil turn to its adjacent turn at said attachment point.

7. The coil of claim 5 or 6 wherein the coil attachment points are equiangularly spaced apart on each intermediate turn of the coil.

8. The barrier coil of claim 1 wherein the multiple coil attachment points of each said turn of the coil are circumferentially spaced apart in succession, alternately, to adjacent trailing and leading turns of the coil.

9. The barrier coil of claim 1 wherein the multiple coil attachment points are generally equiangularly spaced apart on each said turn of the coil.

10. The barrier coil of claim 1 wherein the tape is formed of metal strip stock.

11. The barrier coil of claim 1 wherein the tape includes barb clusters spaced apart along its length.

12. The barrier coil of claim 1 wherein the number of coil attachment points on each said turn of the coil is an odd number.

13. A barrier comprising a body formed of strip material having opposite first and second ends, the opposite first and second ends being interconnected by a body portion therebetween formed of a plurality of intermediate strips, the strip material being formed of substantially planar metal strip stock including barb clusters spaced apart along the length of the strip material, the intermediate strips each comprising a linear length of material having equally spaced apart fold points, each strip length being reversely folded at successive fold points and providing a sawtooth profile, each intermediate strip being rigidly and permanently fixed at spaced attachment points in alternate succession to adjacent trailing and adjacent leading strips of the barrier, the intermediate strips thereby being secured to prevent longitudinal movement relative to the adjacent strips at said attachment points, the barrier being extensible from a retracted position, wherein adjacent strips are in collapsed nested relation to one another, to a deployed position with adjacent strips of the barrier being in extended relation to one another between the attachment points.

14. The barrier of claim 13 wherein the fold points of each intermediate strip length are permanently fixed in alternating succession to corresponding fold points of adjacent trailing and leading strip lengths.

15. The barrier of claim 13 wherein barrier mounting means is connected to end strips at opposite ends of the barrier, the barrier mounting means at opposite ends of the barrier being relatively movable toward and away from one another for collapsing the strips into said retracted position, wherein adjacent strips are in collapsed nested relation, and for extending the strips relative to one another into said barrier deployed position.

16. The barrier of claim 13 wherein each strip length is formed of metal, and wherein a barb cluster is formed intermediate each adjacent pair of fold points on each strip length.

17. A barrier coil extensible and retractable about its central axis and comprising a continuous strip of coiled material, the coil having opposite terminal end turns and a plurality of closed intermediate turns of substantially uniform size, each intermediate turn of the coil being permanently fixed at a first point to an adjacent trailing turn of the coil and at a second point to an adjacent leading turn of the coil, and a coil turn spacer assembly extending longitudinally of the coil in parallel relation to its axis and being secured at interconnecting corresponding points of the coil turns, the spacer asembly having substantially equal lengths between secured interconnecting points of the coil turns with such lengths each being relatively stiff and flexible but movable into a folded position within the coil upon coil collapse, the lengths of the spacer assembly being formed of a material providing a memory set in folded position for repeated retraction into an interference-free folded position upon coil collapse.

18. The coil of claim 17 wherein the spacer assembly comprises a wire rope cable, and fasteners for securing the wire rope cable at corresponding points, respectively, of the coil turns.

19. The coil of claim 18 wherein the wire rope cable is encased within an outer plastic jacket.

20. The barrier coil of claim 17 wherein said interconnecting corresponding points of the coil turns, to which the lengths of the spacer assembly are secured, are adjacent a corresponding set of permanently fixed coil attachment points.

21. A barrier coil extensible and retractable about its central axis and comprising a continuous strip of coiled metal material, the coil having opposite terminal end turns and a plurality of closed intermediate turns of substantially uniform size, each intermediate turn of the coil being permanently fixed at a first point to an adjacent trailing turn of the coil and at a second point to an adjacent leading turn of the coil, and an intrusion detection system for signaling intrusion into the space encompassed by said coil as well as physical disruption of the continuity of said coil including a microwave energy source for directing said energy along the axis of said coil, the frequency of the energy being such as to cause the energy to be guided by said coil along its axis, a receiver for transmitted microwave energy, and a detector for indicating a reduction in received energy at the receiver caused by intrusion into or disruption of the energy guided path determined by said coil.

22. The coil of claim 21 wherein the amplification of said transmitted energy can be controlled to minimize false detector signals caused by weather conditions, small animal intrusion and the like.

23. The coil of claim 21 further including a coil turn spacer assembly extending longitudinally of the coil in parallel relation to its axis and being secured at interconnecting corresponding points of the coil turns, the spacer assembly having substantially equal lengths between secured interconnecting points of the coil turns.

24. An extensible and retractable barrier panel comprising a plurality of linear lengths of strip material of substantially uniform size, each strip length being reversely folded at successive fold points along the strip length and providing a sawtooth profile, the fold points of each strip intermediate opposite end strips being permanently fixed in alternating succession along the strip length to corresponding fold points of adjacent trailing and leading strip lengths.

25. The panel of claim 24 wherein the fold points of each strip length are equally spaced apart to form segments of equal length along each strip length.

26. The panel of claim 25 wherein the strip material is formed of metal tape and wherein the fold points of each strip length extend between opposite side edges of the tape.

27. The panel of claim 26 wherein the permanently fixed fold points of the adjacent metal tapes are each formed by a spot-weld permanently securing each strip length to its adjacent strip length at said selected point.

28. The panel of claim 27 wherein an obstacle protrusion is formed on each tape segment intermediate its fold points.

29. The panel of claim 27 wherein a barb cluster is formed on each tape segment intermediate its ends.

30. The panel of claim 29 wherein each barb cluster comprises two barb pairs on opposite edges of the tape with the barbs of each pair extending generally parallel to a central longitudinal axis of its linear tape segment.

31. The panel of claim 24 wherein panel mounting means is connected to end strips at opposite ends of the panel, the mounting means at opposite ends of the panel being relatively movable toward and away from one another for collapsing the strips into a retracted position, wherein adjacent strips are in collapsed nested relation, and for extending the strips relative to one another into a barrier deployed position.

32. The panel of claim 31 wherein the panel mounting means comprises a rod supporting each end strip of the panel, each end strip being slidably secured to its respective rod for accommodating extension and retraction of the panel strips toward and away from a retracted position with the adjacent panel strips in collapsed nested relation.

33. A combined physical barrier and intrusion detection system comprising a metal barrier formed of at least one substantially constant diameter helical coil extending between two locations, a microwave energy source for directing said energy along the axis of said coil, the frequency of the energy being such as to cause the energy to be guided by said coil along its axis, a receiver for transmitted microwave energy, and a detector for indicating a reduction in received energy at the receiver caused by intrusion into or disruption of the energy guided path determined by said coil.

34. The system of claim 33 wherein the amplification of said transmitted energy can be controlled to minimize false detector signals caused by weather conditions, small animal intrusion and the like.

35. A barrier coil extensible and retractable about its central axis and comprising a continuous strip of coiled material, the coil having opposite terminal end turns and a plurality of intermediate turns of substantially uniform size, the continuous strip defining a major surface which in its width direction is generally parallel to that of an adjacent turn of the coil and which in the length direction of such major surface presents a continuous face extending longtiudinally along the length of the strip, the strip having barbs forming in spaced relation to one another along the length of the strip to protrude laterally outwardly from an edge of the major surface of the strip, each intermediate turn of the coil being permanently fixed at a first point to an adjacent trailing turn of the coil and at a second point to an adjacent loading turn of the coil such that each intermediate turn of the coil is permanently fixed at mutiple coil attachment points in circumferentially spaced succession, alternately, to adjacent trailing and leading turns of the coil, the number of coil attachment points on each intermediate turn of the coil being an odd number.

36. The coil of claim 35 wherein the multiple coil attachment points are equiangularly spaced apart on each intermediate turn of the coil.

* * * * *

REEXAMINATION CERTIFICATE (1123rd)

United States Patent [19]

Mainiero et al.

[11] B1 4,503,423

[45] Certificate Issued Sep. 12, 1989

[54] EXTENSIBLE AND RETRACTABLE BARRIER AND ELECTROMAGNETIC INTRUSION DETECTOR THEREFOR

[75] Inventors: Joseph J. Mainiero, Hauppauge, N.Y.; Michael R. Mainiero, Monroe; Arthur T. Stanley, Shelton, both of Conn.

[73] Assignee: American Fence Company, Inc., Phoenix, Ariz.

Reexamination Request:
No. 90/001,565, Jul. 22, 1988

Reexamination Certificate for:

| | |
|---|---|
| Patent No.: | **4,503,423** |
| Issued: | **Mar. 5, 1985** |
| Appl. No.: | **340,516** |
| Filed: | **Jan. 18, 1982** |

[51] Int. Cl.[4] ..... G08B 13/18; H01P 3/00; E04H 17/04; B21F 25/00

[52] U.S. Cl. ..... 340/552; 256/8; 333/242

[58] Field of Search ..... 340/552; 256/8, 2, 24; 333/242, 239

[56] References Cited

U.S. PATENT DOCUMENTS

| | | | |
|---|---|---|---|
| 2,908,484 | 10/1959 | Uhl | 256/8 |
| 3,463,455 | 8/1969 | Meckel | 256/8 |
| 4,040,603 | 8/1977 | Mainiero | 256/8 |

FOREIGN PATENT DOCUMENTS 480082 2/1938 United Kingdom .

OTHER PUBLICATIONS

1981 Sweets Catalog File—Productions for Industrial Construction and Renovation—Sec. 2.13 "Man Barrier Corporation", Jan. 6, 1981.

*Primary Examiner*—Glen R. Swann, III
*Attorney, Agent, or Firm*—Marvin A. Glazer; William C. Cahill

[57] ABSTRACT

A continuous strip of coiled material is provided with protrusions, such as barbs, which are oriented to eliminate mutual interference when the coiled material is stacked in a compact, collapsed nested condition and wherein each turn of the coil is permanently fixed at equiangularly spaced multiple points alternately to its adjacent trailing and leading turns of the coil. An intrusion detection system signals intrusion into the space encompassed by the above mentioned coil and features a microwave energy source, receiver and detector for indicating a reduction in received microwave energy at the receiver indicative of intrusion into or other disruption of the energy guided path determined by the coil. Another embodiment of the barrier provides for similarly barbed strip material provided in a series of linear lengths with each length reversely folded at a succession of fold points to provide a sawtooth profile with the fold points permanently fixed alternately to corresponding fold points of adjacent trailing and leading strip lengths.

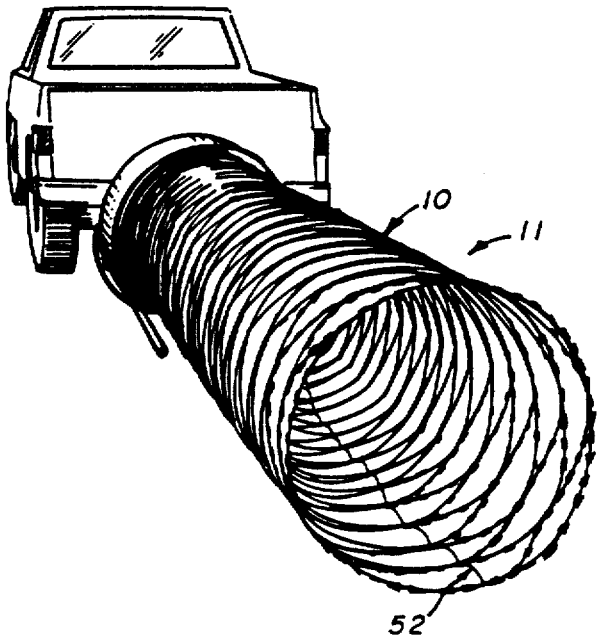

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–34 is confirmed.

Claim 35 is determined to be patentable as amended.

Claim 36, dependent on an amended claim, is determined to be patentable.

New claim 37 is added and determined to be patentable.

35. A barrier coil extensible and retractable about its central axis and comprising a continuous strip of coiled material, the coil having opposite terminal end turns and a plurality of intermediate turns of substantially uniform size, the continuous strip defining a major surface which in its width direction is generally parallel to that of an adjacent turn of the coil and which in the length direction of such major surface presents a continuous face extending longitudinally along the length of the strip, the strip having barbs [forming] *formed* in spaced relation to one another along the length of the strip to protrude laterally outwardly from an edge of the major surface of the strip, each intermediate turn of the coil being permanently fixed at a first point to an adjacent trailing turn of the coil and at a second point to an adjacent [loading] *leading* turn of the coil such that each intermediate turn of the coil is permanently fixed at [mutiple] *multiple* coil attachment points in circumferentially spaced succession, alternately, to adjacent trailing and leading turns of the coil, the number of coil attachment points on each intermediate turn of the coil being an odd number.

*37. A barrier coil extensible and retractable about its central axis and comprising a continuous strip of coiled material, the coil having opposite terminal end turns and a plurality of intermediate turns of substantially uniform size, the continuous strip defining a major surface which in its width direction is generally parallel to that of an adjacent turn of the coil and which in the length direction of such major surface presents a continuous face extending longitudinally along the length of the strip, the strip having barbs formed in spaced relation to one another along the length of the strip to protrude laterally outwardly from an edge of the major surface of the strip, each intermediate turn of the coil being rigidly and permanently fixed at a first point to an adjacent trailing turn of the coil and at a second point to an adjacent leading turn of the coil such that each intermediate turn of the coil is rigidly and permanently fixed at multiple coil attachment points in circumferentially spaced succession, alternately, to adjacent trailing and leading turns of the coil, the number of coil attachment points on each intermediate turn of the coil being an odd number, said coil attachment points preventing any relative longitudinal movement or slipping or twisting of adjacent turns of the coil at their points of attachment.*

* * * * *